US007561173B2

(12) United States Patent
Hirai

(10) Patent No.: US 7,561,173 B2
(45) Date of Patent: Jul. 14, 2009

(54) THERMAL PRINTER

(75) Inventor: Kimitaka Hirai, Chiba (JP)

(73) Assignee: Seiko Instruments Inc. (JP)

( * ) Notice: Subject to any disclaimer, the term of this patent is extended or adjusted under 35 U.S.C. 154(b) by 135 days.

(21) Appl. No.: 11/893,888

(22) Filed: Aug. 17, 2007

(65) Prior Publication Data

US 2008/0068438 A1 Mar. 20, 2008

(30) Foreign Application Priority Data

Sep. 15, 2006 (JP) ..... 2006-250418

(51) Int. Cl.
*B41J 2/335* (2006.01)

(52) U.S. Cl. ..... 347/220

(58) Field of Classification Search ..... 347/220, 347/197–198; 400/120.16–120.17
See application file for complete search history.

(56) References Cited

U.S. PATENT DOCUMENTS

2004/0119808 A1* 6/2004 Mori ..... 347/220
2005/0068405 A1* 3/2005 Ito ..... 347/197

FOREIGN PATENT DOCUMENTS

| | | |
|---|---|---|
| EP | 1 323 535 A | 7/2003 |
| EP | 1 516 737 A1 | 3/2005 |
| JP | 07 314806 | 12/1995 |

* cited by examiner

*Primary Examiner*—K. Feggins
(74) *Attorney, Agent, or Firm*—Adams & Wilks

(57) ABSTRACT

There is provided a thermal printer (1) including: a main body frame (2); a thermal head (4) swingably mounted to the main body frame (2); a platen roller (6) disposed to be opposed to a printing surface (4*a*) of the thermal head (4), for sandwiching a thermal paper with the thermal head (4) to feed the thermal paper; a lock arm (5) swingably mounted to the main body frame (2), for locking the platen roller (6) with the main body frame (2) by pressing a shaft bearing (9) which rotatably supports the platen roller (6) against the thermal head (4); a first spring (7) disposed between the lock arm (5) and the thermal head (4), for biasing the platen roller (6) in a direction in which the platen roller (6) moves toward the thermal head (4); and a second spring (8) disposed between the thermal head (4) and the main body frame (2), for biasing the thermal head (4) in a direction in which the thermal head (4) comes into close contact with the platen roller (6), in which the first spring (7) is disposed so that the first spring (7) applies a biasing force to the lock arm (5) at a position where the first spring (7) is closer to a swing center (3) of the lock arm (5) than the second spring (8) is.

4 Claims, 4 Drawing Sheets

THERMAL PRINTER

BACKGROUND OF THE INVENTION

1. Field of the Invention

The present invention relates to a thermal printer.

2. Description of the Related Art

As a conventional thermal printer, there is one disclosed in Patent Document 1.

The thermal printer disclosed in Patent Document 1 is constituted so that a pressure spring is disposed between a back surface of a thermal head and a lock arm for supporting a platen roller disposed so as to be opposed to a printing surface side of the thermal head. Due to a biasing force of the pressure spring, the platen roller and the thermal head come into close contact with each other by a predetermined pressurizing force.

In the thermal printer described in Patent Document 1, in a case where a thermal paper is jammed between the platen roller and the thermal head or the like, it is necessary to swing the lock arm to allow the platen roller and the thermal head to be spaced apart from each other. Herein, the lock arm is allowed to swing to make the platen roller and the thermal head be spaced apart largely from each other. Accordingly, the jammed paper can be readily removed. In addition, after the jammed paper is completely removed, due to the biasing force of the pressure spring, the platen roller and the thermal head can be returned to original positions thereof.

According to the thermal printer, the pressure spring is shared as a pressure spring for pressing the platen roller and the thermal head by the predetermined pressurizing force so as to be in close contact with each other and as a pressure spring for reversing the swing of the lock arm. Thus, components can be reduced in number and cost can be reduced, which are advantageous.

However, in the thermal printer described in Patent Document 1, for the pressure spring to efficiently apply its pressurizing force to the thermal head, it is preferable that the pressure spring be disposed on an extended line connecting a contact position of the thermal head and the platen roller and an axial center of the platen roller. Accordingly, a position of the pressure spring is distant from a swing center of the lock arm, which is inconvenient. That is, a stroke of the pressure spring to secure a sufficient swing range of the lock arm becomes large, which is inconvenient.

In the case where the stroke of the pressure spring is large, a space in which the pressure spring having the large stroke and a portion of the lock arm are disposed is needed at the back surface side of the thermal head. Thus, there arises a problem in that the back surface side of the thermal head cannot be made compact.

[Patent Document 1] JP 2000-318260 A

SUMMARY OF THE INVENTION

The present invention has been made in view of the circumstances described above, and it is an object of the present invention to provide a thermal printer in which a back surface side of a thermal head is made compact, and a depth dimension as a whole is made smaller.

In order to solve the above-mentioned problems, the present invention provides the following means.

The present invention provides a thermal printer including: a main body frame; a thermal head swingably mounted to the main body frame; a platen roller disposed to be opposed to a printing surface of the thermal head, for sandwiching a thermal paper with the thermal head to feed the thermal paper; a lock arm swingably mounted to the main body frame, for locking the platen roller with the main body frame by pressing a shaft bearing which rotatably supports the platen roller against the thermal head; a first spring disposed between the lock arm and the thermal head, for biasing the platen roller in a direction in which the platen roller moves toward the thermal head; and a second spring disposed between the thermal head and the main body frame, for biasing the thermal head in a direction in which the thermal head comes into close contact with the platen roller, in which the first spring is disposed so that the first spring applies a biasing force to the lock arm at a position where the first spring is closer to a swing center of the lock arm than the second spring is.

According to the present invention, due to an operation of the second spring disposed between the main body frame and the thermal head swingably mounted to the main body frame, the thermal head is biased to the platen roller side. Meanwhile, due to the first spring disposed between the lock arm and the thermal head, the platen roller supported by the lock arm is biased to the thermal head side. As a result, the thermal head and the platen roller come into close contact with each other by a predetermined pressurizing force. Therefore, by sandwiching the thermal paper therebetween and feeding the thermal paper by the platen roller, printing can be performed according to a heating pattern of the thermal head.

In this case, the second spring for pressing the thermal head does not need a large stroke, so a spring having a short stroke and a large pressurizing force can be employed as the second spring. Meanwhile, the first spring needs to allow the lock arm to swing over a long swing range. However, the first spring is disposed at the position closer to the swing center of the lock arm than the second spring is, so a spring having a short stroke and a large pressurizing force can be employed as the first spring. As a result, as springs disposed at a back surface side of the thermal head, springs having short strokes can be employed with the result that a provision space of the springs can be made smaller to make it compact.

In the above-mentioned invention, the second spring may apply a biasing force to the thermal head on an extended line connecting a contact position of the thermal head and the platen roller and an axial center of the platen roller.

Accordingly, the pressurizing force of the second spring can be efficiently transmitted with respect to the printing surface of the thermal head provided at the contact position of the thermal head and the platen roller. As a result, the pressurizing force of the second spring can be minimized, and a more compact spring can be used.

Further, in the above-mentioned invention, it is preferable that the first spring be constituted by a conical coil spring.

Accordingly, solid height of the first spring with respect to the pressurizing force can be reduced. As a result, the space of the back surface side of the thermal head can be compactly constituted.

Further, in the above-mentioned invention, the first spring may be constituted by a plate spring.

Also as described above, the solid height of the first spring with respect to the pressurizing force can be reduced. As a result, the space of the back surface side of the thermal head can be compactly constituted.

According to the present invention, there are effects that the back surface side of the thermal head is made compact and a depth dimension as a whole can be made smaller.

DETAILED DESCRIPTION OF THE PREFERRED EMBODIMENT

Referring to FIGS. 1 to 4, a thermal printer 1 according to an embodiment of the present invention will be described below.

Figure 1:
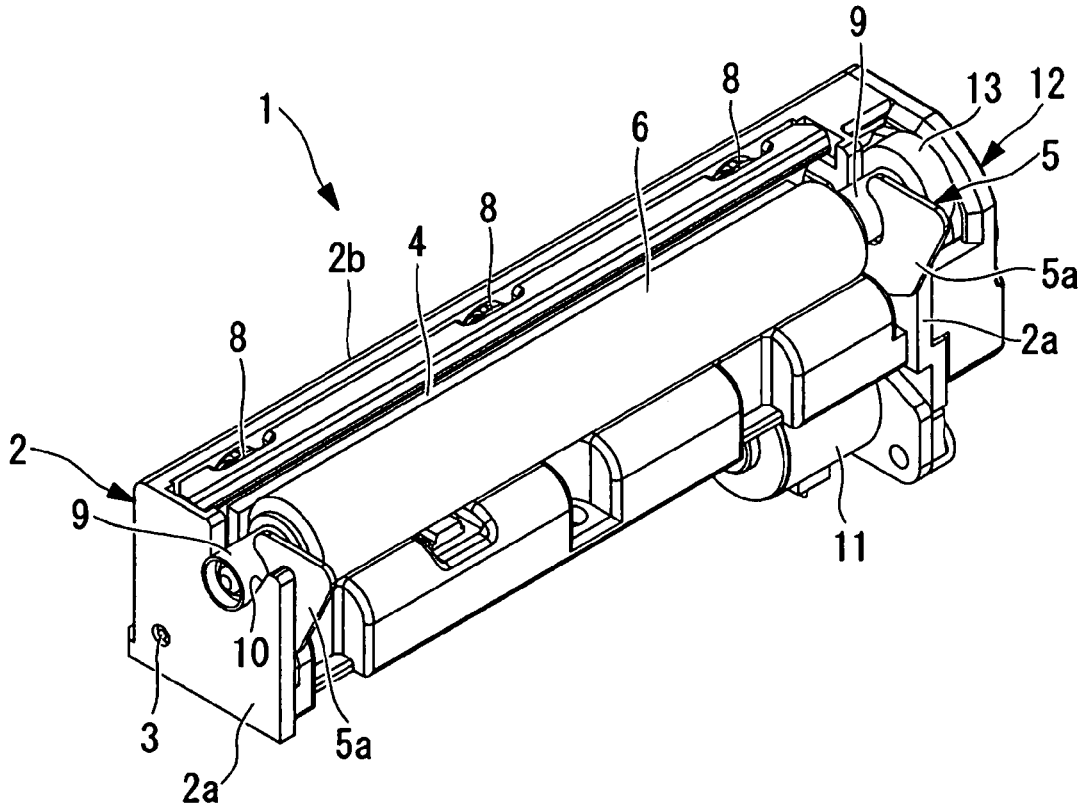
FIG. 1 is a perspective view showing a thermal printer according to an embodiment of the present invention.
Figure 2:
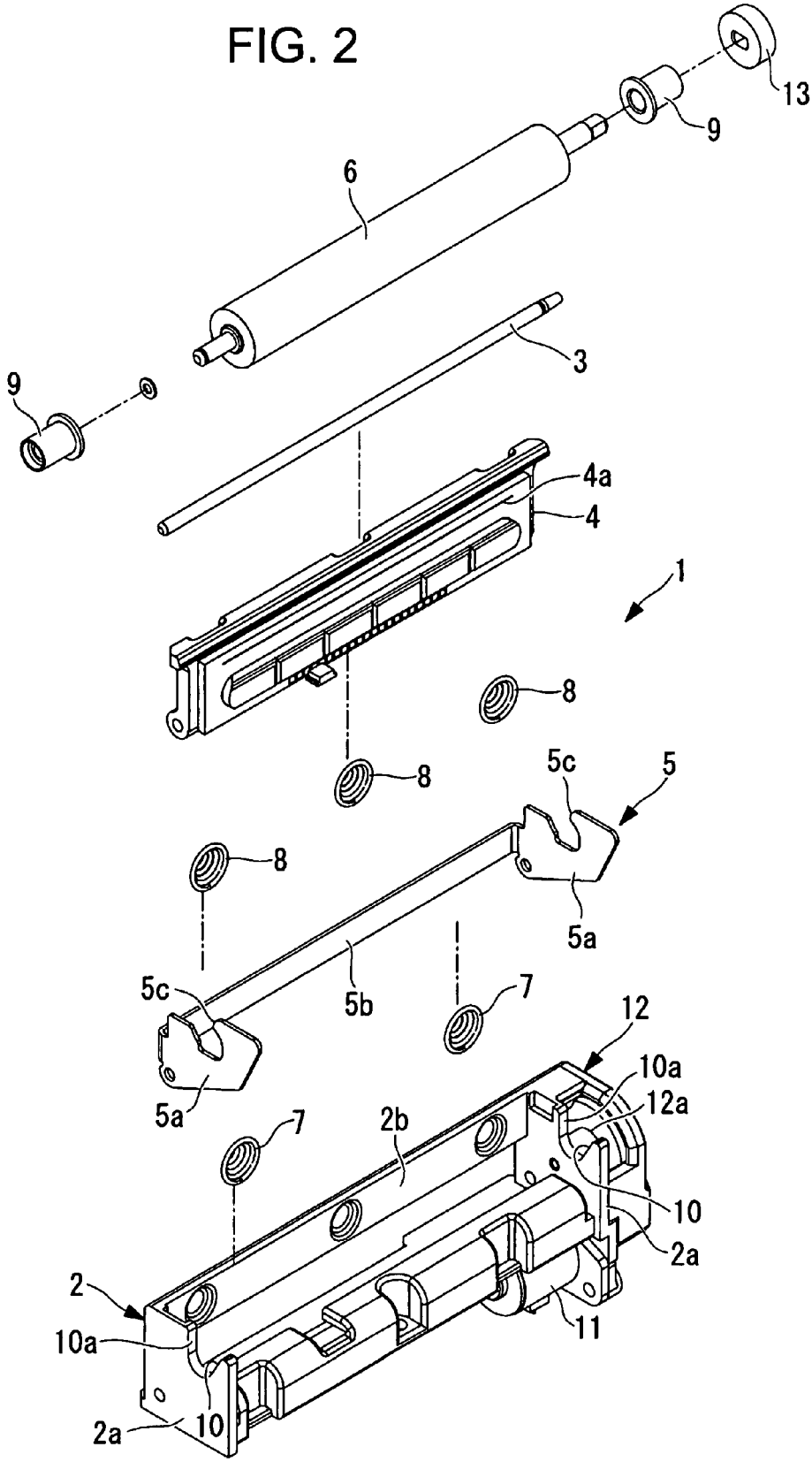
FIG. 2 is an exploded perspective view showing structural components of the thermal printer of FIG. 1.

As shown in FIGS. 1 and 2, the thermal printer 1 of this embodiment includes: a main body frame 2; a thermal head 4 and a lock arm 5 swingably mounted to a coaxial shaft 3 of the main body frame 2; a platen roller 6 supported by the lock arm 5; first springs 7 for biasing the platen roller 6 to the thermal head 4 side; and second springs 8 for biasing the thermal head 4 in the platen roller 6 direction.

The main body frame 2 is provided with side walls 2*a* for bridging the shaft 3 and a back surface coupling plate portion 2*b* for coupling the side walls 2*a*. The side walls 2*a* of the main body frame 2 are provided with notches 10, respectively, for receiving a shaft bearing 9 (described later) of the platen roller 6. The notches 10 are provided with stopblock edges 10*a* provided in parallel so as to be spaced apart by a predetermined distance from the back surface coupling plate portion 2*b*. Further, each notch 10 is formed such that an opening width thereof is increased in its opening direction, and has a structure for readily receiving each shaft bearing 9 of the platen roller 6. Further, the main body frame 2 is provided with a motor 11 and a rotation transmitting mechanism 12 for transmitting a rotational force of the motor 11 to the platen roller 6.

Figure 3:
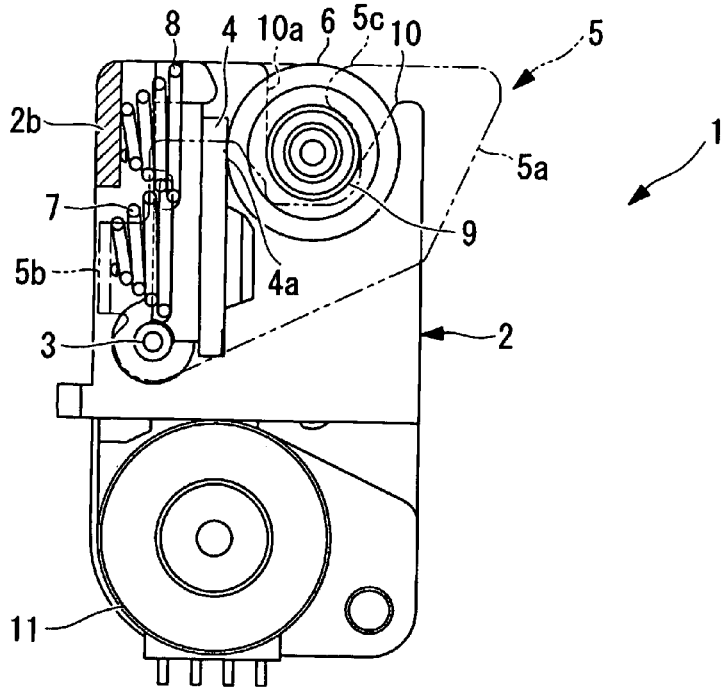
FIG. 3 is a longitudinal sectional view showing the thermal printer of FIG. 1 in a state where a platen roller is mounted.
Figure 4:
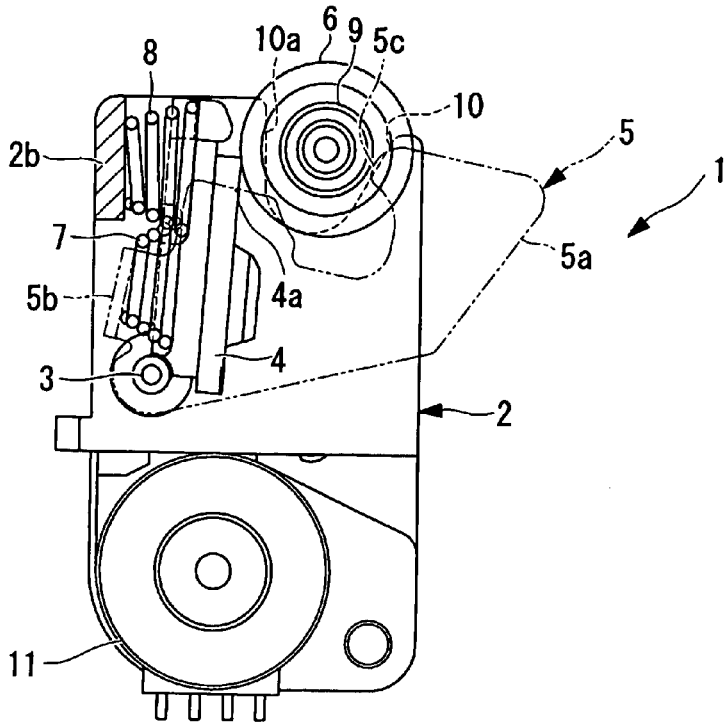
FIG. 4 is a longitudinal sectional view showing the thermal printer of FIG. 1 in a state where a platen roller is unmounted.

As shown in FIGS. 3 and 4, the thermal head 4 is mounted to the shaft 3 mounted to the main body frame 2 so as to be capable of swinging about the shaft 3 in a state where a side surface, which is a back surface of a printing surface 4*a* provided on one surface side, is opposed to the back surface coupling plate portion 2*b* of the main body frame 2. The printing surface 4*a* of the thermal head 4 is disposed at a position where the printing surface 4*a* approximately corresponds to the back surface coupling plate portion 2*b* in a thickness direction of the thermal head 4.

Further, the second springs 8 are sandwiched between the back surface of the thermal head 4 and the back surface coupling plate portion 2*b* of the main body frame 2. Each second spring 8 is a compressed coil spring being a conical coil spring. Accordingly, the thermal head 4 is constantly biased in the printing surface 4*a* side due to a biasing force of the second springs 8.

The shaft bearings 9 for rotatably supporting the platen roller 6 are provided on both ends of the platen roller 6, respectively. Further, a gear 13, which engages with a gear 12*a* of the rotation transmitting mechanism 12 when the shaft bearings 9 are supported by the notches 10, is fixed to an end of the platen roller 6.

The lock arm 5 is swingably mounted to the main body frame 2 by the shaft 3, and includes two side plate portions 5*a* extending along the both side walls 2*a* of the main body frame 2 and a back plate portion 5*b* for coupling the side plate portions 5*a*.

The lock arm 5 is provided with claw portions 5*c* at its end portions, which extend to the printing surface 4*a* side of the thermal head 4 in the state where the lock arm 5 is mounted to the main body frame 2, and prevent the platen roller 6 from being detached by enclosing the shaft bearings 9 of the platen roller 6 supported by the notches 10 of the main body frame 2 to decrease the opening width of the notches 10. Further, in this state, the back plate portion 5*b* of the lock arm 5 is disposed to the back surface side of the thermal head 4.

In addition, as shown in FIGS. 3 and 4, the first springs 7 are sandwiched between the back plate portion 5*b* of the lock arm and the back surface of the thermal head 4. Each first spring 7 is a compressed coil spring being a conical coil spring.

Accordingly, the lock arm 5 is constantly biased by the first springs 7 in a direction in which the shaft bearings 9 of the platen roller 6 are pressed against the stopblock edges 10*a* of the notches of the main body frame 2. Further, in the state where the shaft bearings 9 of the platen roller 6 are pressed against the stopblock edges 10*a* of the notches 10, the claw portions 5*c* decrease the opening widths of the notches 10 and the shaft bearings 9 are supported so as not to be detached from the notches 10, so the platen roller 6 is locked in a positioning state with respect to the main body frame 2.

In this embodiment, the back plate portion 5*b* of the lock arm 5 is disposed closer to the shaft 3 side, serving as a swing center of the lock arm 5, than the back surface coupling plate portion 2*b* of the main body frame 2 is. Accordingly, the first springs 7 sandwiched between the back plate portion 5*b* and the back surface of the thermal head 4 are disposed closer to the swing center than the second springs 8 sandwiched between the back surface coupling plate portion 2*b* and the back surface of the thermal head 4 are.

An operation of the thermal printer 1 of this embodiment structured as described above will be described below.

According to the thermal printer 1 of this embodiment, in performing printing while sandwiching a thermal paper (not shown) between the thermal head 4 and the platen roller 6, first, the thermal paper is disposed on the printing surface 4*a* of the thermal head 4. Then, an external force is applied to the lock arm 5 to swing the lock arm 5 in a direction in which the claw portions 5*c* move away from the thermal head 4 and to increase opening width of the notches 10 provided to the side walls 2*a* of the main body frame 2.

In this case, the first springs 7 disposed between the back plate portion 5*b* of the lock arm 5 and the back surface of the thermal head 4 are compressed, so the lock arm 5 is swung against a biasing force of the first springs 7. In order to satisfactorily increase the opening width of each notch 10 of each side wall 2*a* of the main body frame 2, the claw portions 10*c* of the lock arm 5 should be satisfactorily swung. Accordingly, the first springs 7 are compressed.

In this embodiment, the first springs 7 are disposed closer to the shaft 3, serving as an axial center of the swing of the lock arm 5, than the claw portions 5*c* of the lock arm 5 are. Therefore, the first springs 7 having a stroke satisfactorily smaller than a displacement amount of the claw portions 5*c* can be used. As a result, a provision space of the first springs 7 disposed on the back surface side of the thermal head 4 can be made smaller.

As the first springs 7, conical coil springs are used. Thus, it is possible to reduce solid height thereof, and the provision space thereof can be made further smaller.

Further, in a state where the platen roller 6 is not mounted, the thermal head 4 is biased to the printing surface 4*a* side by the second springs 8 to swing about the shaft 3. In a case where the lock arm 5 is swung in a direction in which the opening width of the notches 10 are increased, the platen roller 6 is detached from the notches 10. Thus, the thermal head 4 swings to the printing surface 4*a* side, thereby reducing the stroke of the first springs 7.

Then, the shaft bearings 9 of the both ends of the platen roller 6 are inserted into the notches 10 having the increased opening width, whereby the notches 10, support the shaft bearings 9. In this state, the external force applied to the lock arm 5 is released. Accordingly, the lock arm 5 biases the platen roller 6 in a direction in which the platen roller 6 comes closer to the thermal head 4 and presses the shaft bearings 9 against the stopblock edges 10*a* of the notches 10 of the main body frame 2, the claw portions 5*c* move in a direction in which the opening width of the notches 10 are decreased, and the shaft bearings 9 of the platen roller 6 are supported by the claw portions 5*c* so as not to be detached from the notches 10. Accordingly, the platen roller 6 is locked in a positioning state with respect to the main body frame 2.

In this embodiment, the thermal head 4 is biased to the printing surface 4*a* side by the second springs 8. Thus, at a midst position of the lock operation by the lock arm 5, the platen roller 6 sandwiches the thermal paper with the printing surface 4*a* of the thermal head 4. When the lock operation by the lock arm 5 completes, the platen roller 6 holds the thermal paper to press the thermal head 4, thereby compressing the second springs 8.

In this case, the shaft bearings 9 of the platen roller 6 are pressed against the stopblock edges 10*a* of the notches 10, whereby the platen roller 6 is positioned. In addition, the position of the back surface coupling plate portion 2*b* for supporting the second springs 8 is fixed. Therefore, when the platen roller 6 is locked by the lock arm 5, the second springs 8 are always compressed by a specific length. Accordingly, the thermal paper is always sandwiched between the thermal head 4 and the platen roller 6 by a specific pressurizing force with the result that stable printing can be performed without fluctuating printing conditions. Then, the platen roller 6 is rotated by the operation of the motor 11 via the rotation transmitting mechanism 12 to feed the thermal paper, whereby printing is performed by the thermal head 4.

Further, the second springs 8 are disposed so as to be opposed to a contact position of the platen roller 6 and the printing surface 4*a* of the thermal head 4 with an intermediation of the thermal head 4, and apply a biasing force along an extended line connecting the contact position and a center position of the platen roller 6. Thus, the biasing force which is generated by the second springs 8 can be efficiently used as a pressurizing force of the printing surface 4*a* with respect to the thermal paper to minimize dimensions of the second springs 8. Further, in this embodiment, the second springs 8 for pressing the thermal head 4 are not used to return the lock arm 5 to its original state, so each second spring 8 does not need large stroke. Therefore, it is possible to reduce the stroke to make the provision space smaller.

As described above, in the thermal printer 1 according to this embodiment, the second springs 8 for the thermal head 4 requiring no large stroke are separated from the first springs 7 for the lock arm 5 requiring a stroke, and the first springs 7 are disposed in the vicinity of the swing center of the lock arm 5. Therefore, the back surface side of the thermal head 4 is made compact, and there is an advantage in that a depth dimension as a whole can be made smaller.

Note that, in the thermal printer 1 according to this embodiment, conical coil springs are employed as the first springs 7 and the second springs 8. Alternatively, as shown in FIG. 5, plate springs may be employed.

Figure 5:
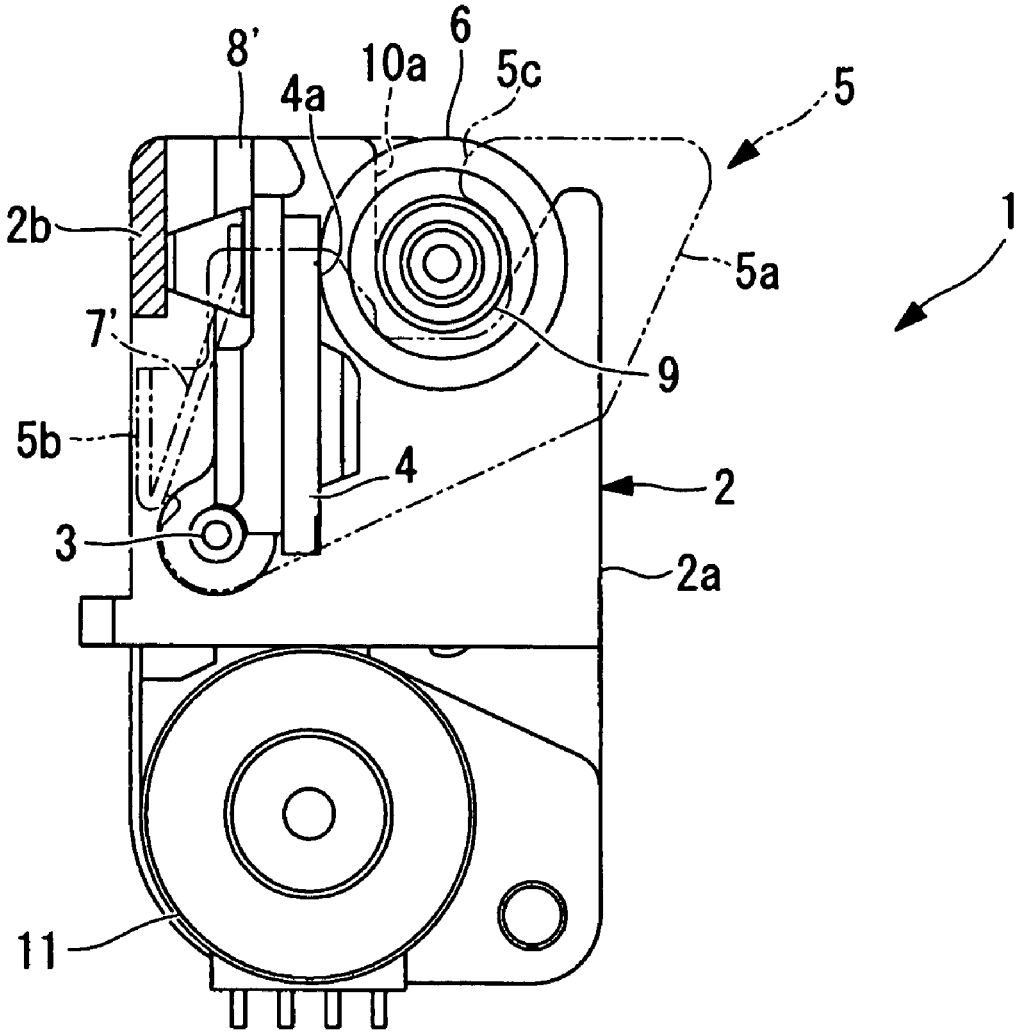
FIG. 5 is a longitudinal sectional view showing a modification example of the thermal printer of FIG. 1.

In FIG. 5, a first spring 7' for biasing the lock arm 5 and a second spring 8' for pressing the thermal head 4 are constituted by different plate springs.

The first spring 7' is constituted by extending a portion of the back plate portion 5*b* constituting the lock arm 5. Another end of the first spring 7' is extended to a back surface side of the second spring 8', so the biasing force for biasing the thermal head 4 with respect to the platen roller 6 can be increased.

Further, by separately providing the first spring 7' and the second spring 8', as described above, the provision space in the back surface side of the thermal head 4 can be made smaller to make it compact. In particular, by employing the plate springs, even in the smaller provision space, a relatively large biasing force can be exerted to perform stable printing.

What is claimed is:

1. A thermal printer, comprising:

a main body frame;

a thermal head swingably mounted to the main body frame;

a platen roller disposed to be opposed to a printing surface of the thermal head, for sandwiching a thermal paper with the thermal head to feed the thermal paper;

a lock arm swingably mounted to the main body frame, for locking the platen roller with the main body frame by pressing a shaft bearing which rotatably supports the platen roller against the thermal head;

a first spring disposed between the lock arm and the thermal head, for biasing the platen roller in a direction in which the platen roller moves toward the thermal head; and a second spring disposed between the thermal head and the main body frame, for biasing the thermal head in a direction in which the thermal head comes into close contact with the platen roller, wherein the first spring is disposed so that the first spring applies a biasing force to the lock arm at a position where the first spring is closer to a swing center of the lock arm than the second spring is.

2. A thermal printer according to claim 1, wherein the second spring applies a biasing force to the thermal head on an extended line connecting a contact position of the thermal head and the platen roller and an axial center of the platen roller.

3. A thermal printer according to claim 1, wherein the first spring is constituted by a conical coil spring.

4. A thermal printer according to claim 1, wherein the first spring is constituted by a plate spring.

* * * * *